US006974225B2

(12) United States Patent
Weng

(10) Patent No.: US 6,974,225 B2
(45) Date of Patent: Dec. 13, 2005

(54) SEQUENCE LIGHTING SYSTEM FOR FOOTWEAR

(76) Inventor: Ming-Bi Weng, 235 Chung-Ho Box 8-24, Taipei (TW)

( * ) Notice: Subject to any disclaimer, the term of this patent is extended or adjusted under 35 U.S.C. 154(b) by 142 days.

(21) Appl. No.: 10/642,485

(22) Filed: Aug. 18, 2003

(65) Prior Publication Data

US 2004/0212317 A1 Oct. 28, 2004

Related U.S. Application Data

(60) Provisional application No. 60/465,761, filed on Apr. 24, 2003.

(51) Int. Cl.[7] ..... F21V 21/08

(52) U.S. Cl. ..... 362/103; 362/104; 362/157; 315/133; 315/200 A; 340/669; 340/815.45; 446/485

(58) Field of Search ..... 362/103, 85, 104, 362/157, 184, 227, 234, 252; 315/133, 200 A, 315/76, 129, 360–363; 340/669, 665, 815.45, 340/540, 573.1, 3.7, 815.4; 446/484, 485

(56) References Cited

U.S. PATENT DOCUMENTS

| | | | | |
|---|---|---|---|---|
| 5,177,467 A * | 1/1993 | Chung-Piao | ..... | 362/103 |
| 5,663,614 A * | 9/1997 | Weng et al. | ..... | 362/103 |
| 5,812,063 A * | 9/1998 | Weng et al. | ..... | 362/103 |
| 5,903,103 A * | 5/1999 | Garner | ..... | 315/76 |
| 5,969,479 A * | 10/1999 | Wong | ..... | 315/76 |

* cited by examiner

*Primary Examiner*—Thomas M. Sember
*Assistant Examiner*—Ismael Negron

(57) ABSTRACT

A lighting system with plurality of displaying sequences for a footwear comprises a plurality of light emitting sources; a power source for providing power; a switch turning "on" or "off" responsive to motions of the footwear; a key trigger being triggered in response to the turning "on" of the switch in an actuating period and the key trigger being inactive in response to an inactive time period; and a light source display sequence driver for driving the light sources to flash; the light source display sequence driver including a plurality of sequences for flashing the light sources and a plurality of dummy sequences for flashing no light sources.

2 Claims, 5 Drawing Sheets

SEQUENCE LIGHTING SYSTEM FOR FOOTWEAR

The present invention is a non-provisional patent application of the U.S. provisional patent No. 60/465,761 assigned to the inventor of the present invention. Thereby, the content of the U.S. Provisional patent No. 60/465,761 is incorporated into the present invention as a part of the present invention.

FIELD OF THE INVENTION

The present invention relates to light footwear, and particularly to a lighting footwear having a various flash sequence.

BACKGROUND OF THE INVENTION

Light footwear is popular with men, women and children for reasons of safety by rendering the wearers more visible at night, and for reasons of fashion. Such footwear typically includes at least one light source and preferably a plurality of light sources such as light emitting diodes, a source of power such as a battery, and a switch to connect the battery to the light source to illuminate them.

There are known in the art several different implementation of footwear lighting systems that produce flashing lights, these implementations typically rely on the opening and closing of a switch to create the flashing effect. Many different types of switches have been used to create this effect. For example, pressure switches, mercury switches, and spring switches have all been used to generate flashing lights in footwear. However, in all of these systems, flashing only occurs in response to the connection or disconnection of the circuit created by the opening and closing of the switch. Furthermore, in systems which a plurality of lights, the lights, are illuminated in unison, with all the lights being illuminated at the same time.

FIG. 1 shows a lighting circuit assembly for shoes according to the prior art. This lighting circuit assembly comprises a switch 2', a control unit 3' controlled by the switch 2' to drive a plurality of LEDs (light emitting diodes) 5', causing them to flash, and an oscillation resistor 4' adapted for regulating the flashing speed of the LEDs 5'. The control unit 3' is triggered by a triggering signal from the switch 2' to drive the LEDs 5', causing the LEDs 5' to flash at one of four flashing modes. The flashing frequency of the LEDs 5' is controlled at one per every 1 to 5 seconds.

SUMMARY OF THE INVENTION

The present invention provides a lighting system with plurality of displaying sequences for a footwear which comprises a plurality of light emitting sources; a power source for providing power; a switch turning "on" or "off" responsive to motions of the footwear; a key trigger being triggered in response to the turning "on" of the switch in an actuating period and the key trigger being inactive in response to an inactive time period; and a light source display sequence driver for driving the light sources to flash; the light source display sequence driver including a plurality of sequences for flashing the light sources and a plurality of dummy sequences for flashing no light sources.

The present invention relates to various objects and advantages of the present invention will be more readily understood from the following detailed description when read in conjunction with the appended drawing.

DESCRIPTION OF THE PRESENT INVENTION

Figure 1:
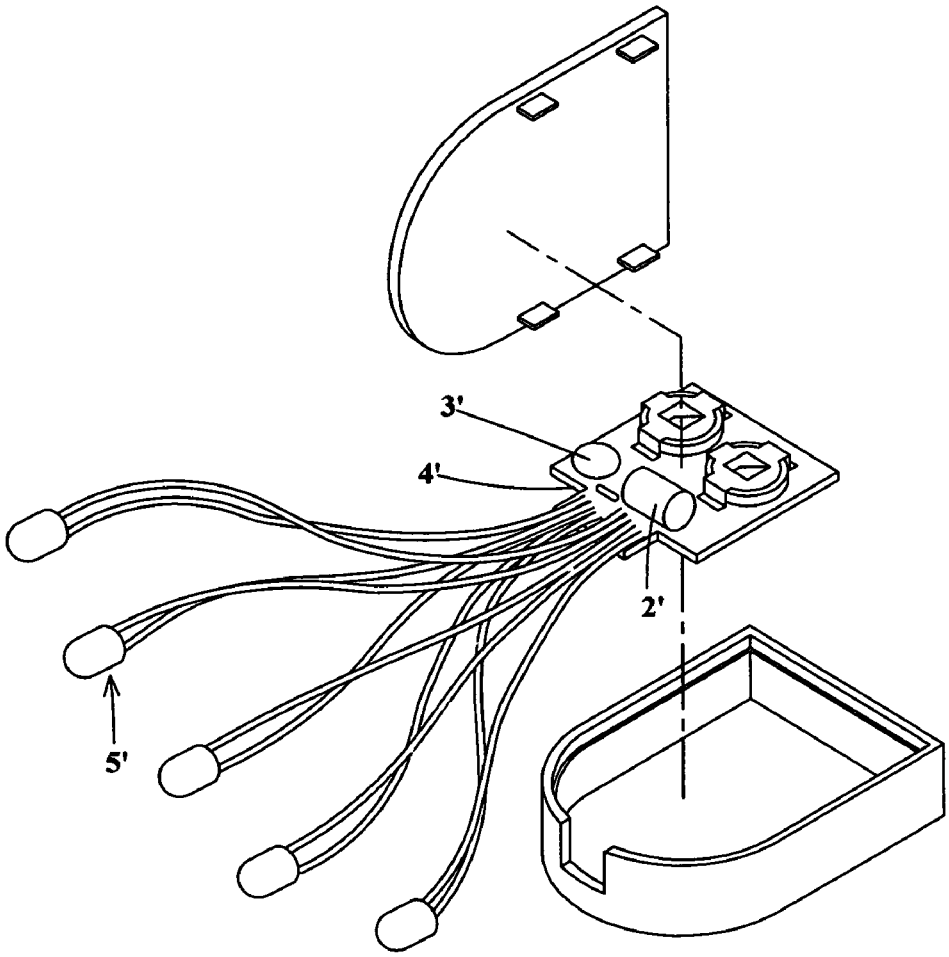
FIG.1 (PRIOR ART)
FIG. 1 shows a prior art lighting footwear.
Figure 2:
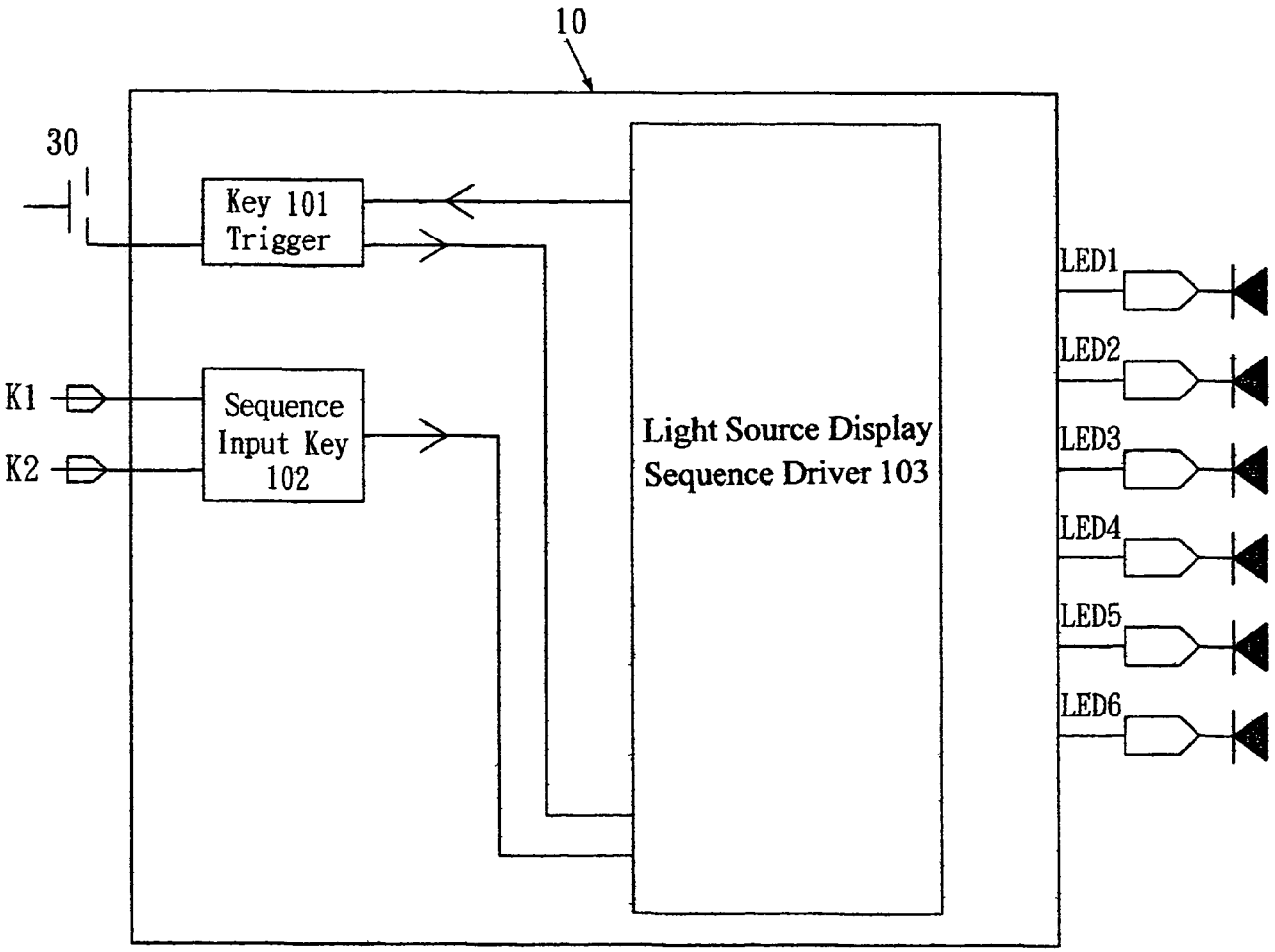
FIG. 2 shows the block diagram of the present invention.

Referring to FIG. 2, the functional block of the present invention is illustrated.

In the present invention, a lighting system is incorporated in the sole of a footwear and includes at least one light source and preferably a plurality of light source, e.g., LED1, LED2, LED3, LED4, LED5, and LED6. Rather than light emitting diodes, incandescent, electro-luminescent, infrared, or ultraviolet light source can be used. All these are within the scope of the present invention. The light source can be arranged around the periphery of the heel of the sole, but they can be arranged anywhere on the shoe, including the upper side. The number of light sources used can not confined.

The light sources LED1 to LED 6 receive electrical current from a module 10, preferably embedded in the sole. The module contains a battery (not shown), for example, a 3 volt lithium battery having the shape of a circular disk. The battery is mounted on one side of the module 10.

The plurality of light emitting sources LED1 to LED 6 arrange on one side of the module 10.

A power source (not shown) serves for providing power to all the elements of the module 10.

A switch 30 is on one side of the module 10, the switch 30 turned "on" or "off" responsive to the motion of the footwear.

A key trigger 101 in the module 10 can be triggered in response to the turning "on" of the switch 30 in an actuating period. The actuating period is a period in which the key trigger can be actuated in response to the action of the switch 30. In the present invention, also an inactive time period is defined, which will be discussed in the following.

A sequence input key 102 has a plurality of inputs K1 and K2 for determining a display sequence of the light sources.

A light source display sequence driver 103 serves for driving the light sources in response to the actions of the key trigger 101 and the sequence input key 102. The light source display sequence driver 103 has a plurality of function blocks which execute the respective predetermined functions defined in the blocks.

Figure 3:
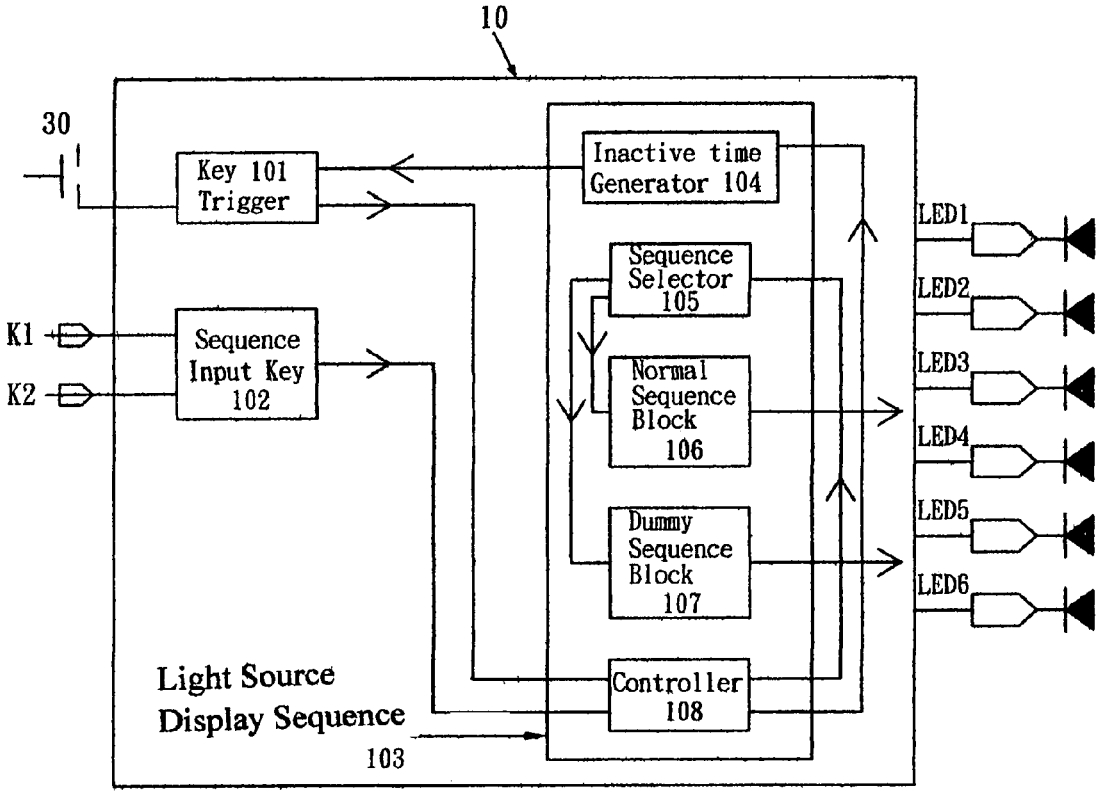
FIG. 3 shows the block diagram of the present invention, where the block diagram of the present invention.
Figure 4:
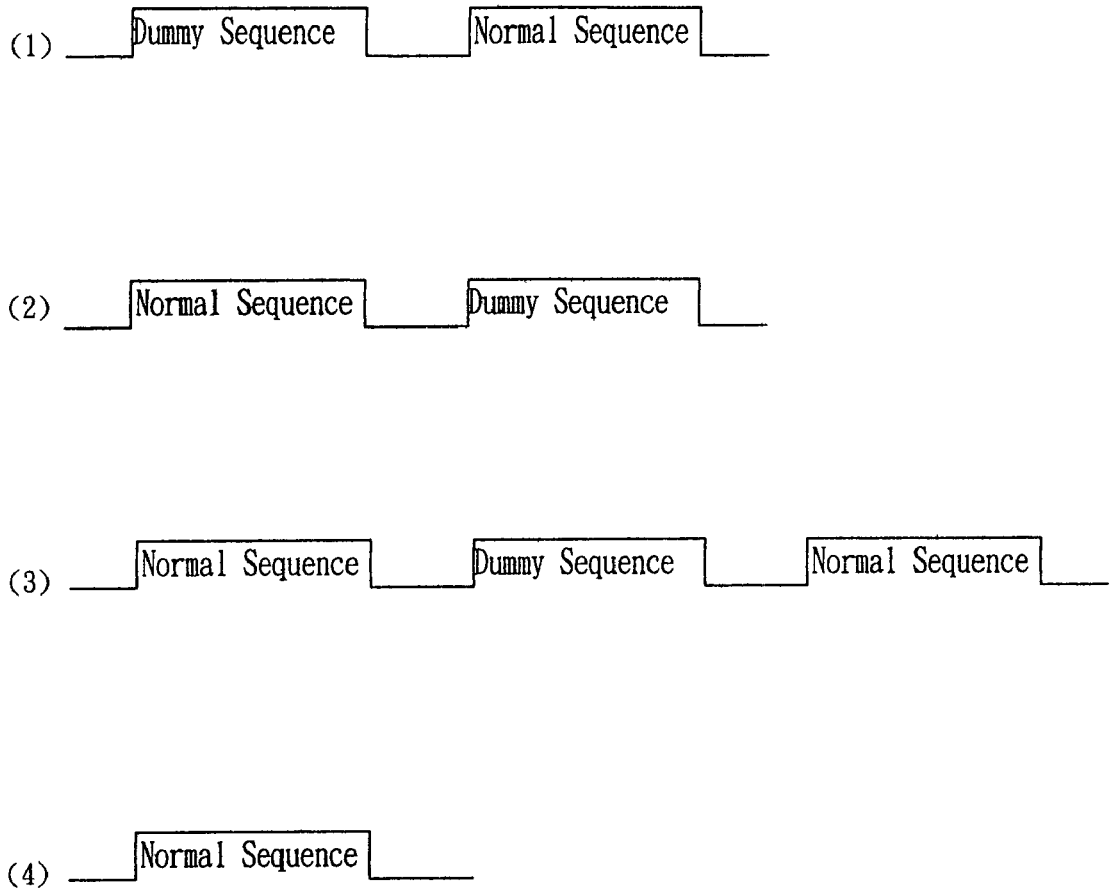
FIG. 4 shows a variety of example about the arrangements of the dummy sequence and normal sequence.

Referring to FIG. 3, the detail of the light source display sequence driver 103 is further illustrated, wherein all the detail elements are shown. The light source display sequence driver 103 comprises the following components.

An inactive time generator 104 in the light source display sequence driver 103 serves for generating an inactive time period to the key trigger 101. In this inactive time period, the key trigger will be inactive even the switch turns "on", that is, the turning "on" of the switch 30 will not actuate the key trigger 101 and thus the actions of the light sources are not affected by the switch 30.

A controller 108 receives the inputs from the key trigger 101 and a sequence input key 102. The controller 108 is actuated by the key trigger 101 so as to display the light sources in response to a selective sequence from the sequence input key 102.

A sequence selector 105 serves for actuating a sequence for displaying the light sources according to the indication from the controller 108. The sequence selector 105 also actuates the inactive time generator 104 for generating an inactive time period according to a selected sequence from the controller 108.

A normal sequence block 106 stores a plurality of sequences for actuating the light sources. The normal sequence block 106 actuates a selected sequence in response to an indication from the sequence selector 105.

A dummy sequence block 107 stores a plurality of dummy sequences, i.e., sequences which do not actuate any light sources. The dummy sequence block 107 actuates no light source. In the present invention, the dummy sequences serve to provide a delay time for displaying the light sources and different dummy sequences provides different delay time. Moreover, the dummy sequence can be used with the normal sequences so that the display of the light sources can present many different patterns to enjoy the users and viewers.

With reference to FIG. 3, three operation modes about the operation of the present invention is illustrated. In the first operation mode, the dummy sequence is arranged before the normal sequence. In the second operation mode, the dummy sequence is arranged between normal sequences, and in the third operation mode, the dummy sequence is operated after flashing of the normal sequence. Moreover, a fourth operation mode is provided, where no dummy sequence is provided, but only normal sequence is used. However, all the modes are within the scope of the present invention.

The determination of flash sequence, the dummy sequence and normal sequence, can be determined randomly by using a random generator in the light source display sequence driver 103, which can be arranged in the controller 108 or in the sequence selector 105 or as an independent element. In another embodiment, the determination of flash sequence, the dummy sequence and normal sequence, is purely by the input of the sequence input key 102.

Figure 5:
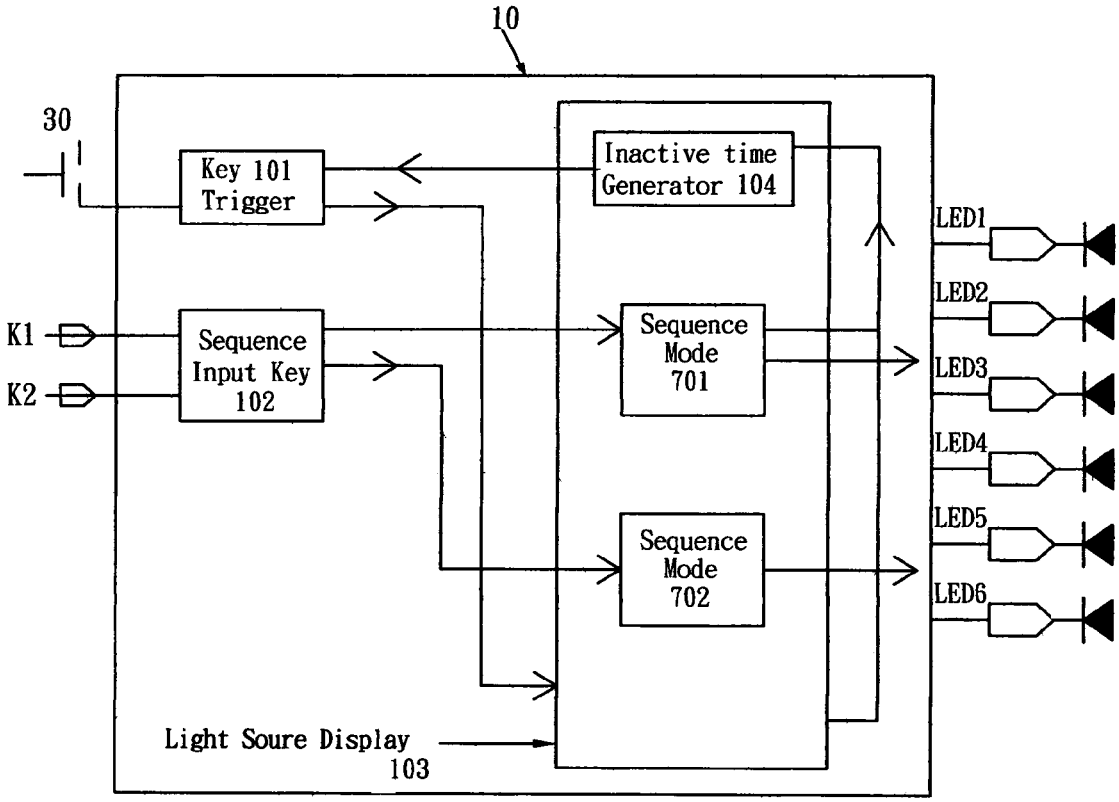
FIG. 5 shows another embodiment of the present invention, wherein a circuit with simpler structure than those illustrated in FIG. 3 is shown.

Referring to FIG. 5, another embodiment of the present invention is illustrated, wherein a circuit with simpler structure than those illustrated in FIG. 3 is shown. The embodiment shown in FIG. 5 is similar to those illustrated in the embodiment illustrated in FIG. 3 except that the controller and sequence selector is not used. In this embodiment, the flash sequence is wholly determined by the sequence input key 102. There are plurality of sequence modes 701, 702 being set in the light sequence driver 106. Each sequence mode has a flashing sequence which includes normal sequence and dummy sequence. That is, the flash sequence is determined manually and the flash sequences are layout in the light source display sequence driver 103 in advance, it is preferably by hardware structure. Each sequence mode 701, 702 has a corresponding sequence input key 102 so that the actuation of the sequence mode 701, 702 is controlled by the sequence input key 102.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A lighting system with plurality of displaying sequences for a footwear comprising:

a plurality of light emitting sources;

a power source for providing power;

a switch turning "on" and "off" responsive to motions of the footwear;

a key trigger being triggered in response to the turning "on" of the switch in an actuating period and the key trigger being inactive in response to an inactive time period;

a sequence input key; the sequence input key having a plurality of inputs for determining a flashing sequence of the light sources;

a light source display sequence driver for driving the light sources to flash; the light source display sequence driver including a plurality of normal sequences for flashing the light sources and a plurality of dummy sequences for flashing no light sources;

wherein the light source display sequence driver further comprises:

an inactive time generator for generating an inactive time period to the key trigger, the trigger being inactive during the inactive time period even if the switch turns "on";

a controller receiving inputs from the key trigger and sequence input key; so as to cause the light sources to emit light in response to a selective sequence from the sequence input key; the controller being actuated by the key trigger; the controller randomly determining a sequence for the illumination of the light sources;

a sequence selector actuating a sequence for displaying the light sources according to the indication from the controller; the sequence selector actuating the inactive time generator for generating an inactive time period according to a selected sequence from the controller;

a normal sequence block storing a plurality of sequences for actuating the light sources; the normal sequence block actuating a selected sequence in response to an indication from the sequence selector; the dummy sequence arranged in one of a plurality of positions including before flash of the normal sequence; between two normal sequences, after flashing of the normal sequence;

a dummy sequence block storing a plurality of dummy sequences which do not actuate any light sources, the dummy sequence block actuating no light source;

a random generator determining an order of the dummy sequence and normal sequence.

2. The lighting system as claimed in claim 1, further comprising:

a sequence input key for inputting a flash sequence of the light sources to the light source display sequence driver.

* * * * *